US009705271B2

(12) United States Patent
Kitamura et al.

(10) Patent No.: US 9,705,271 B2
(45) Date of Patent: Jul. 11, 2017

(54) FITTING STRUCTURE FOR CONNECTOR

(71) Applicants: AUTONETWORKS TECHNOLOGIES, LTD., Yokkaichi-shi, Mie (JP); Sumitomo Wiring Systems, Ltd., Yokkaichi-shi, Mie (JP); SUMITOMO ELECTRIC INDUSTRIES, LTD., Osaka-shi, Osaka (JP); AISIN AW CO., LTD., Anjo-shi, Aichi (JP)

(72) Inventors: Keishi Kitamura, Yokkaichi (JP); Yoshihiro Mizutani, Yokkaichi (JP); Yasuto Takeda, Yokkaichi (JP); Hiroki Hirai, Yokkaichi (JP); Tetsuji Tanaka, Yokkaichi (JP); Hiroyoshi Maesoba, Yokkaichi (JP); Kosuke Sone, Yokkaichi (JP); Teruo Kato, Anjo (JP); Kazuhisa Nimura, Anjo (JP)

(73) Assignees: AUTONETWORKS TECHNOLOGIES, LTD., Yokkaichi-shi, Mie (JP); SUMITOMO WIRING SYSTEMS, LTD., Yokkaichi-shi, Mie (JP); SUMITOMO ELECTRIC INDUSTRIES, LTD., Osaka-shi, Osaka (JP); AISIN AW CO., LTD., Anjo-shi, Aichi (JP)

( * ) Notice: Subject to any disclaimer, the term of this patent is extended or adjusted under 35 U.S.C. 154(b) by 0 days.

(21) Appl. No.: 15/027,275

(22) PCT Filed: Oct. 6, 2014

(86) PCT No.: PCT/JP2014/076654

§ 371 (c)(1),
(2) Date: Apr. 5, 2016

(87) PCT Pub. No.: WO2015/060110

PCT Pub. Date: Apr. 30, 2015

(65) Prior Publication Data

US 2016/0294138 A1 Oct. 6, 2016

(30) Foreign Application Priority Data

Oct. 25, 2013 (JP) ..... 2013-221983

(51) Int. Cl.
*H01R 13/66* (2006.01)
*H01R 33/945* (2006.01)
(Continued)

(52) U.S. Cl.
CPC ..... *H01R 33/945* (2013.01); *H01R 13/506* (2013.01); *H01R 13/516* (2013.01); *H01R 2103/00* (2013.01)

(58) Field of Classification Search
CPC .. H01R 13/516; H01R 13/506; H01R 33/945; H01R 2103/00
(Continued)

(56) References Cited

U.S. PATENT DOCUMENTS 7,052,308 B2 * 5/2006 Drane ..... H01R 13/506 439/417
2005/0250370 A1 11/2005 Drane et al.

FOREIGN PATENT DOCUMENTS

| | | |
|---|---|---|
| JP | 2-299177 | 12/1990 |
| JP | 2004-273683 | 9/2004 |
| JP | 2012-94289 | 5/2012 |

OTHER PUBLICATIONS

Machine translation of JP 2004 273683.*
Partial translation of office action for PCT/JP2014/076654.*
International Search Report.

* cited by examiner

*Primary Examiner* — Javaid Nasri
(74) *Attorney, Agent, or Firm* — Gerald E. Hespos; Michael J. Porco; Matthew T. Hespos

(57) ABSTRACT

Provided is a connector (10) whereof a cover (60) is prevented from falling off a housing (20). The connector (10) is provided with: the housing (20), which is capable of fitting to a counterpart housing (90) and arranged in proximity or in contact with a peripheral member such as a solenoid (80) when fitting to the counterpart housing (90); and the cover (60), which is independent from the housing (20) and attached to the housing (20) so as to cover an electric wire (100) drawn out from a wire outdrawing surface of this housing (20). When the housing (20) fits to the counterpart housing (90), the cover (60) is faced by the peripheral member in a separating direction from the housing (20) so that the cover (60) is arranged to be interposed between the housing (20) and the peripheral member such as the solenoid (80).

9 Claims, 7 Drawing Sheets

(51) Int. Cl.
*H01R 13/506* (2006.01)
*H01R 13/516* (2006.01)
*H01R 103/00* (2006.01)

(58) Field of Classification Search
USPC ..... 439/620.01
See application file for complete search history.

FITTING STRUCTURE FOR CONNECTOR

BACKGROUND

1. Field of the Invention

The present invention relates to a connector structure.

2. Description of the Related Art

JP 2012-94289 A discloses a connector structure provided with a housing and a cover independent from the housing and housing an electric wire drawn out from an electric wire outdrawing surface in a bent state. The housing is provided with an engagement protrusion, and an engagement hole is provided on a side wall of the cover. The engagement protrusion is fitted into the engagement hole whereby the cover is retained in the housing.

In the above case, when a strong external force is applied to the cover in a direction separating from the housing, the engagement protrusion may be detached from the engagement hole, and there is a risk that the cover falls off the housing.

The present invention has been made based on such a circumstance, and aims to provide a connector that prevents the cover from falling off the housing.

SUMMARY

The present invention is a connector including: a housing configured capable of fitting to a counterpart housing provided to be fixed to a peripheral member and arranged in proximity or in contact with the peripheral member when fitting to the counterpart housing, the housing including a locking part capable of engaging with and retaining the counterpart housing in a fitted state; and a cover that is independent from the housing and attached to the housing so as to cover an electric wire drawn out from an electric wire outdrawing surface of the housing, wherein when the housing fits to the counterpart housing, the cover is faced by the peripheral member in a separating direction of the cover from the housing so that the cover is arranged to be interposed between the housing and the peripheral member.

Since the cover is faced by the peripheral member in a separating direction of the cover from the housing so that the cover is interposed between the housing and the peripheral member, the cover is prevented from falling off the housing.

The separating direction of the cover from the housing may be set to be a direction intersecting a fitting direction to the counterpart housing, and when the housing fits to the counterpart housing, the peripheral member may be arranged at a position where the peripheral member can avoid an interference with the housing that has progressed along the fitting direction when the housing fits to the counterpart housing. According to this, the housing is prevented from interfering with the peripheral member when the housing attached with the cover starts to fit to the counterpart housing, and the fitting work of the two housings can be performed smoothly.

In the cover, a surface on an opposite side from a surface facing the electric wire may have an arc shape that is extending substantially along an outer peripheral surface of the peripheral member about an axis parallel to a fitting direction to the counterpart housing. Due to this, for example, the cover is prevented from interfering with the peripheral member when the peripheral member is angularly displaced about the axis parallel to the fitting direction.

The peripheral member may be a cylindrical solenoid having its axis center directed in the fitting direction. Due to this, the operation of angular displacement about the axis parallel to the fitting direction can be ensured without the solenoid interfering with the cover.

The counterpart housing may be set on the peripheral member. Accordingly, the peripheral member, the housing, and the counterpart housing are arranged within less space by being compactly organized.

The housing may include a housing main body configured capable of housing a terminal metal connected to the electric wire and an eaves part that integrally protrudes out from the housing main body in the fitting direction of the counterpart housing, the cover may include a base part, and a cover locking part that protrudes out from the base part in a direction intersecting the fitting direction, when assembling the cover to the housing, the cover may be restrained from being detached in a direction intersecting the fitting direction by the cover locking part being engaged with a cover lock receiving part of the housing, a through part for passing the electric wire may be formed to be sectioned between the base part and the eaves part, and a surface of the base part on an opposite side from a surface facing the electric wire may be arranged to face the peripheral member. With such a configuration, if the cover locking part is in the half-engaged state with the cover lock receiving part at the start of the fitting of the housings, the base part can interfere with the peripheral member and stop the fitting operation of the housings, so that the half-engaged state of the cover can be detected.

DETAILED DESCRIPTION

Figure 1:
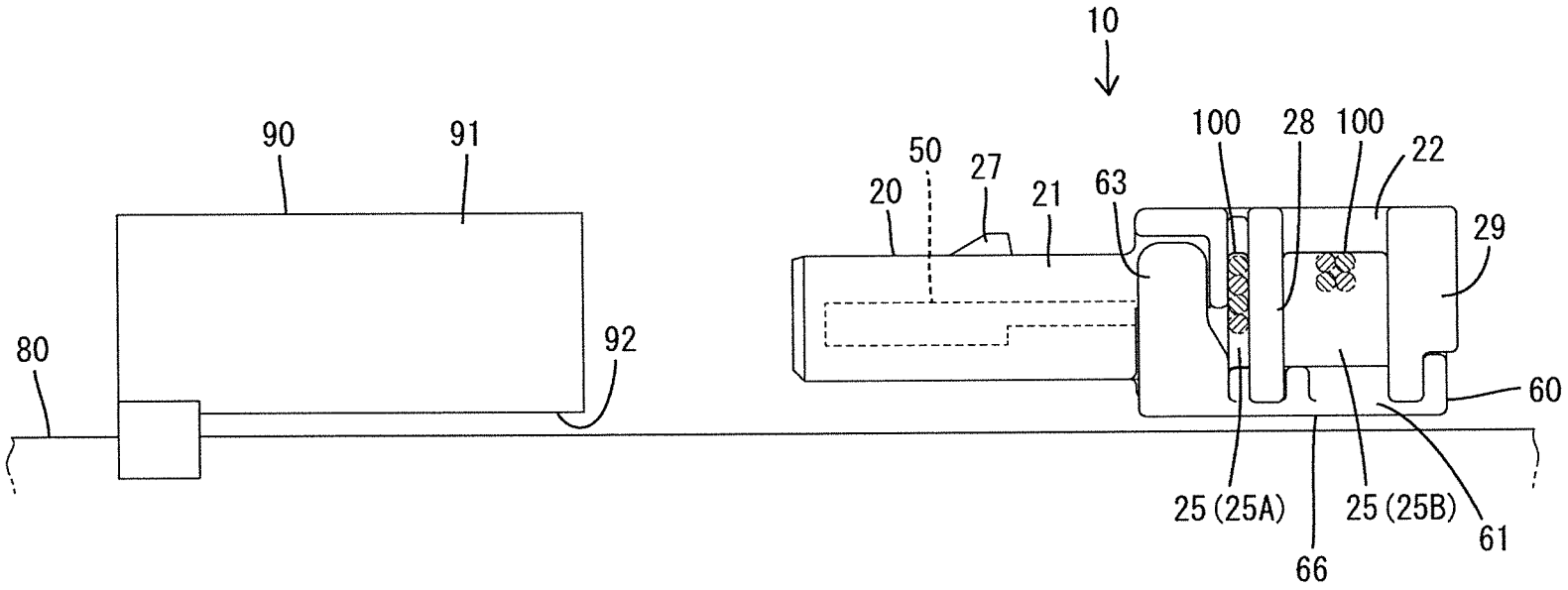
FIG. 1 is a side view illustrating a state where a housing faces a counterpart housing with a cover interposed between the housing and a solenoid in an embodiment 1 of the present invention.

An embodiment of the present invention will be described with reference to FIG. 1 to FIG. 7. A connector 10 of the embodiment includes a housing 20 that can fit to its counterpart housing 90, and a cover 60 to be attached to the housing 20, and the housing 20 and the cover 60 are arranged in proximity to a solenoid 80 as a peripheral member when fitting to the counterpart housing 90. As illustrated in FIG. 2, the solenoids 80 each form a cylindrical shape, and are arranged in plurality in a direction intersecting a front and rear direction while having their axes directed in the front and rear direction (fitting direction of the housings 20, 90) along a part that configures an automatic transmission not illustrated.

Figure 2:
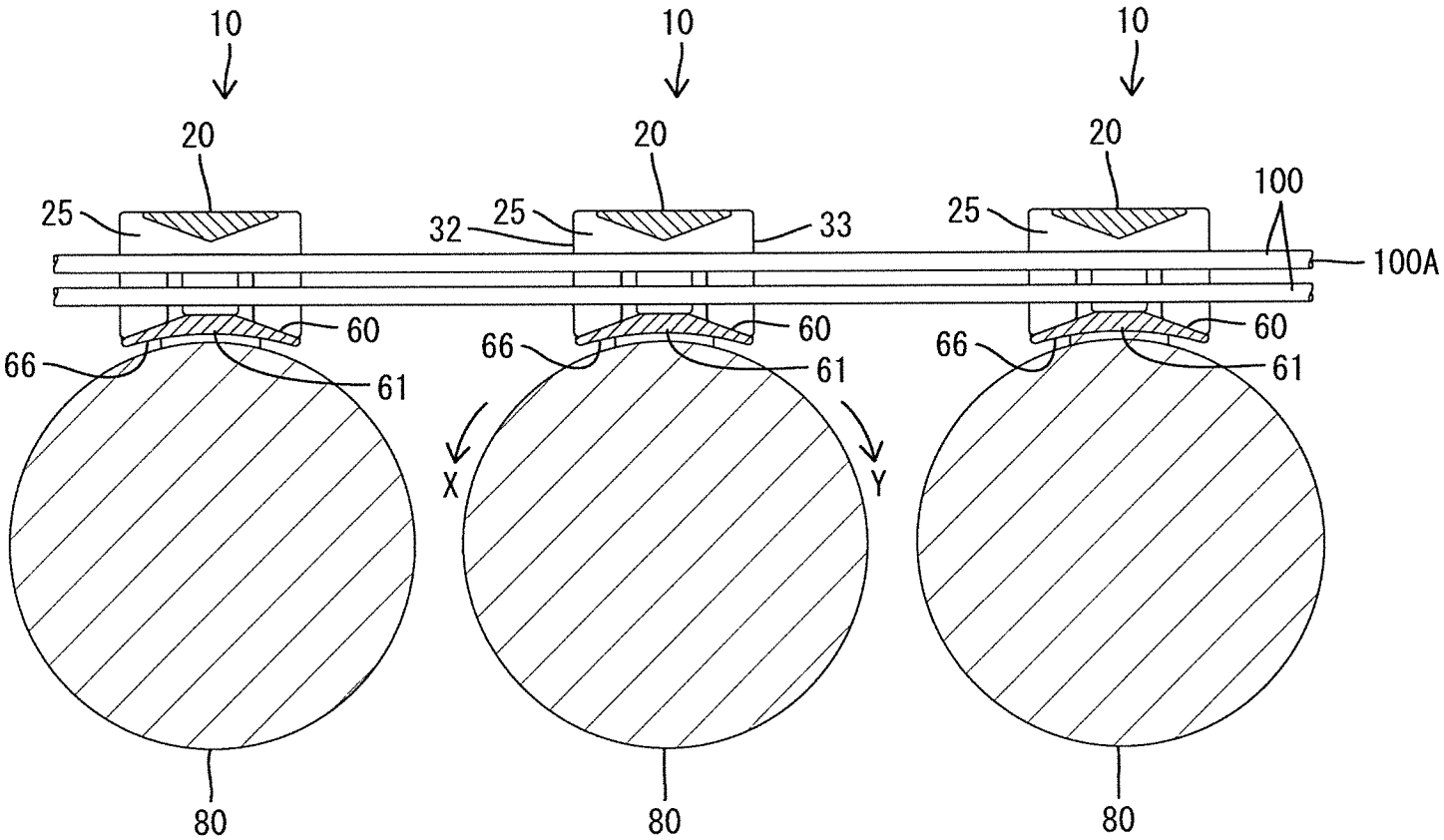
FIG. 2 is a cross sectional view in which the cover is arranged so as to be interposed between the solenoid and the housing and connectors are aligned in plurality in a width direction as seen from a rear side.

The counterpart housing 90 is made of synthetic resin and set fixed to an outer peripheral surface of the respective solenoid 80 as illustrated in FIG. 1. Specifically, the counterpart housing 90 has a cylindrical hood part 91, and a counterpart terminal metal not illustrated is protrudingly arranged within the hood part 91. A lower surface of the hood part 91 is configured as a counterpart arc surface 92 that curves upward in its front view or rear view depicting an arc around an axis parallel to the fitting direction of the housings 20, 90. The counterpart arc surface 92 is arranged along the outer peripheral surface of the solenoid 80 in the setting.

Figure 6:
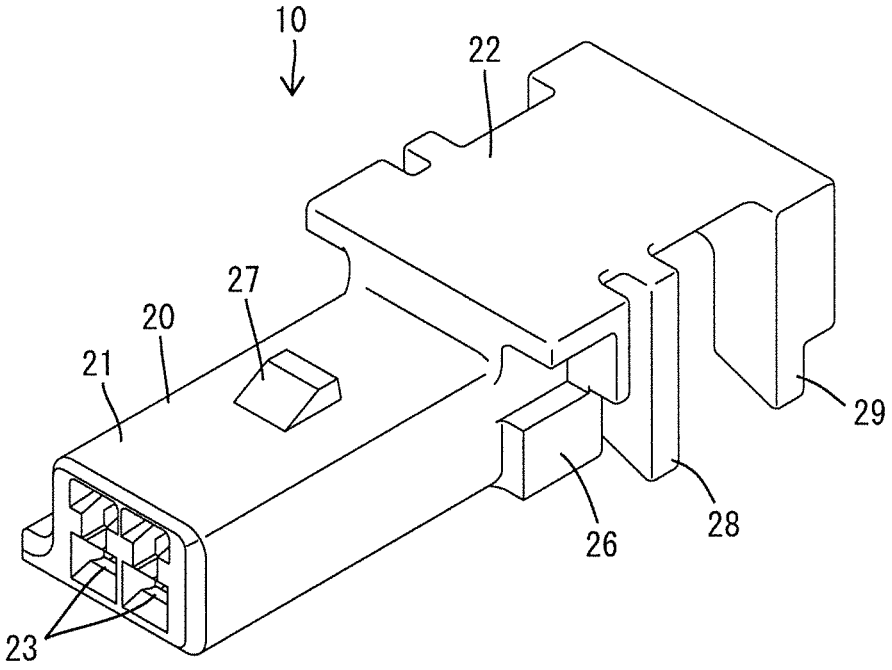
FIG. 6 is a perspective view illustrating the housing.

The housing 20 is also made of synthetic resin, and as illustrated in FIGS. 1 and 6, and includes a block-shaped housing main body 21 that can house terminal metals 50, and an eaves part 22 protruding from a rear end upper edge of the housing main body 21 toward a rear side (fitting direction of the counterpart housing 90) integrally in a state of being wider than the housing main body 21.

Figure 4:
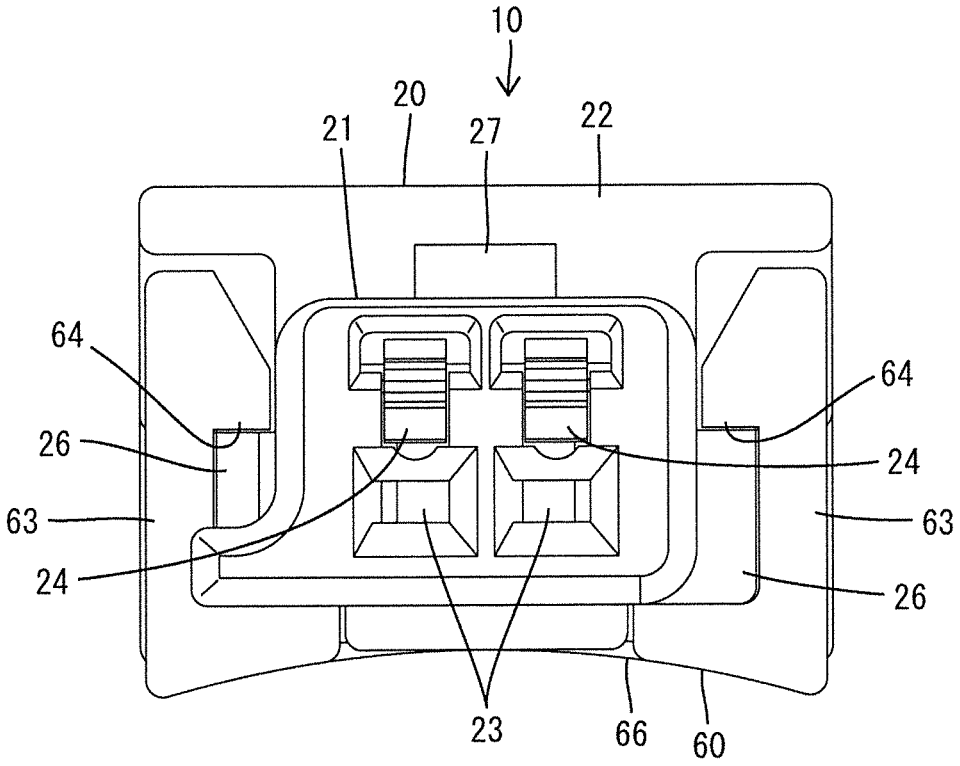
FIG. 4 is a front view m of the connector.

The housing main body 21 is configured capable of fitting into the hood part 91 of the counterpart housing 90, and includes therein cavities 23 into which the terminal metals 50 can be inserted. The cavities 23 are arranged in plurality along a width direction. As illustrated in FIG. 4, a lance 24 is provided protruding from an inner wall of each cavity 23. The terminal metal 50 is elastically engaged to the lance 24 in each cavity 23 in a state of being inserted in a normal posture, and is thereby retained in the cavity 23 in a slip-out prevented state. At this occasion, as illustrated in FIG. 2, electric wires 100 connected to the terminal metals 50 extend out from a rear surface of the housing main body 21 and enter into a through part 25 to be described later, and further are guided to outside in the direction intersecting the fitting direction from the through part 25. The electric wires 100 guided to the outside further pass through the through part 25 of the adjacent housing 20, and are configured capable of entering into the through part 25 of yet another adjacent housing 20, and as a whole configure a main line 100A extending out in the width direction. The main line 100A has a shape retaining property capable of maintaining a state of extending out substantially straight in the width direction by having the plural electric wires 100 bundled within the through parts 25.

Figure 3:
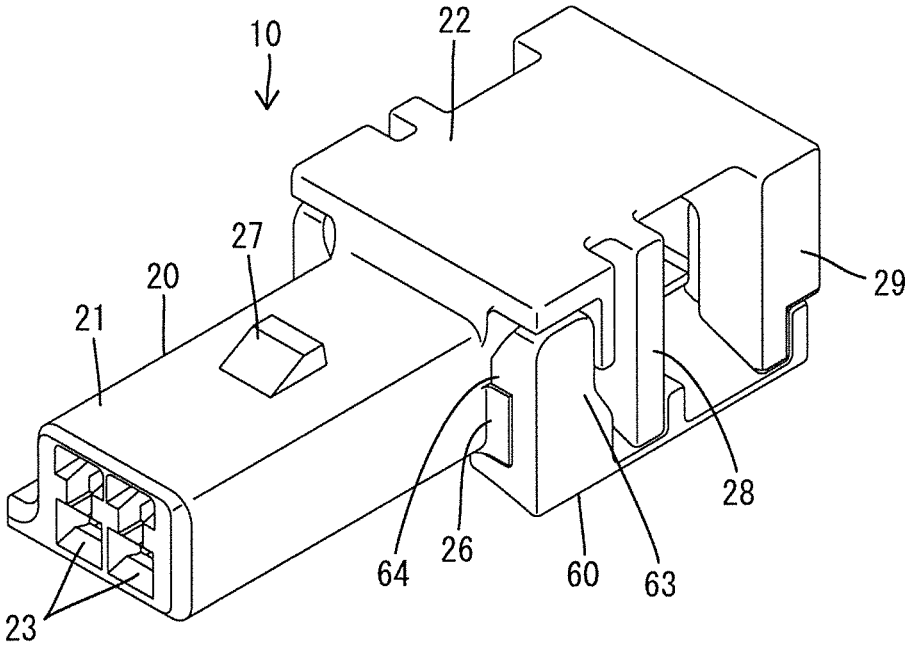
FIG. 3 is a perspective view of the connector.

As illustrated in FIGS. 3 and 4, a pair of cover lock receiving parts 26 engageable to cover locking parts 63 of the cover 60 to be described later are protrudingly provided at a rear end lower part on both side surfaces of the housing main body 21. A locking part 27 capable of engaging with the counterpart housing 90 and retaining it in a fitted state is protrudingly provided on an upper surface of each housing main body 21.

The eaves part 22 has a substantially plate shape that is substantially along the front and rear direction. As illustrated in FIGS. 1 and 6, a pair of partition parts 28 are provided protruding downward at both end portions in the width direction on a front end side of the eaves part 22, and a pair of arm parts 29 are provided protruding downward at both end portions in the width direction on a rear end side of the eaves part 22. Both partition parts 28 have a rectangular plate shape, are arranged facing the rear side of the housing main body 21, and include an opening dimension in which one electric wire 100 can be housed in the front and rear direction between the partition parts 28 and the rear surface of the housing main body 21 in a lateral side view. Further, both arm parts 29 are arranged facing each other to the rearward of the partition parts 28, and have a shape engageable to a back-plate part 62 of the cover 60 to be described later. A pair of inner protrusion parts 31 are provided protruding inward facing each other at lower end portions of both arm parts 29.

Figure 7:
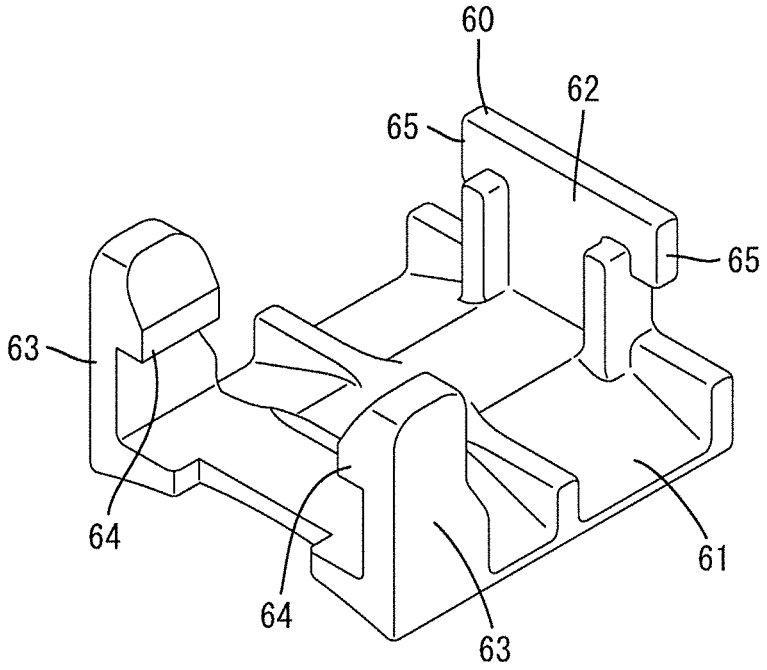
FIG. 7 is a perspective view illustrating the cover.

As illustrated in FIGS. 3 and 4, each cover 60 is assembled from a lower side roughly facing the eaves part 22 relative to the corresponding housing 20 (direction intersecting the fitting direction). Specifically, as illustrated in FIG. 7, the cover 60 includes a curved plate-shaped base part 61 arranged facing the eaves part 22 when being assembled onto the housing 20, the back-plate part 62 protruding upward from a center portion in the width direction at the rear end side of the base part 61, and a pair of cover locking parts 63 protruding upward (direction intersecting the fitting direction, and on the eaves part 22 side upon the assembly) from both end portions in the width direction of the front end side of the base part 61. Pawl-shaped engagement protrusions 64 are provided protruding inward facing each other at upper end portions of both cover locking parts 63. Further, a pair of outer protrusion parts 65 is provided protruding in the width direction at an upper end of the back-plate part 62.

When the cover 60 is retained in the housing 20, the through part 25 penetrating in the width direction is formed to be sectioned between the cover 60 and the housing 20. The through part 25 comes to be in a state of being closed along its entire circumference in the lateral side view by the housing main body 21, the eaves part 22, the arm parts 29, the back-plate part 62, and the base part 61, and as illustrated in FIG. 2. One of the openings on both ends in the width direction comes to be an inlet opening 32 that can introduce the main line 100A of the electric wires 100 from the adjacent through part 25, and the other opening comes to be an outlet opening 33 that can guide out the main line 100A of the electric wires 100 from its own through part 25.

Further, the through part 25 comes to be in a state of being divided into two chambers on the front and rear by the partition parts 28. Specifically, as illustrated in FIG. 1, in the lateral side view, the through part 25 is configured of a first through part 25A sectioned between the rear surface of the housing main body 21 and the partition parts 28 and having a small opening dimension, and a second through part 25B sectioned between the partition parts 28 and the arm parts 29 and having a large opening dimension. The first through part 25A has the electric wires 100 arranged tightly in one vertical line in the height direction (up and down direction), and in the second through part 25B, the electric wires 100 are arranged dispersedly in the height direction and the front and rear direction. Especially, in the first through part 25A, front and rear ends of the electric wires 100 are arranged so as to abut on the rear surface of the housing main body 21 and both partition parts 28, and the electric wires 100 are retained in a state where their free movement in the front and rear direction is restricted.

Figure 5:
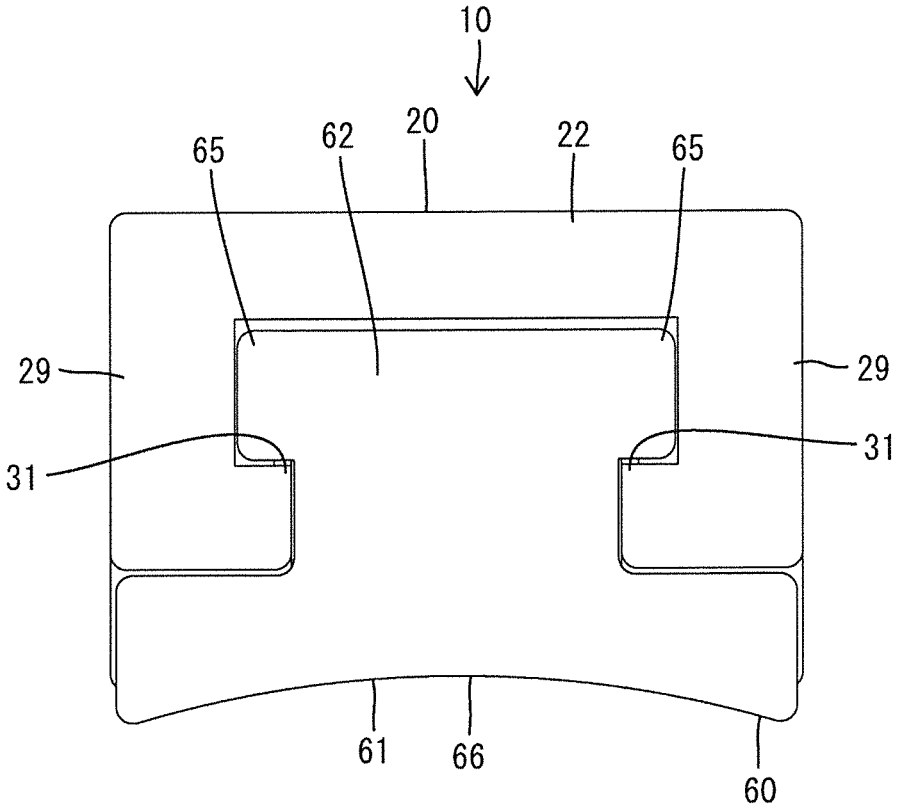
FIG. 5 is a rear view of the connector.

As illustrated in FIGS. 2 and 5, a lower surface of the base part 61 of the cover 60 is configured as a cover arc surface 66 that curves upward depicting an arc in its front view or rear view around an axis that is parallel to the fitting direction of the housings 20, 90. Here, the through part 25 is formed so as to increase its internal volume in a flared shape toward both end sides in the width direction by the cover arc surface 66. Due to this, when the housings 20, 90 are in the fitted state, the straightness of the main line 100A is maintained satisfactorily since the electric wires 100 are allowed to escape in the expanded spaces of the through part 25 even when the solenoid 80 is angularly displaced about the axis parallel to the fitting direction of the housings 20, 90 and the connector 10 accordingly rotates in the angular displacement direction (X direction or Y direction in FIG. 2).

Next, workings of the connectors 10 of the embodiment will be described.

When attaching a cover 60 to its corresponding housing 20, the outer protrusion parts 65 of the cover 60 are hooked onto the inner protrusion parts 31 of the housing 20 (see FIG. 5), and with the hooked positions as the substantial fulcrum points, the cover 60 is rotated upward and forward, and the engagement protrusions 64 of the cover locking parts 63 of the cover 60 are engaged onto the cover lock receiving parts 26 of the housing 20 from below. The engagement protrusions 64 of the cover locking parts 63 abuts on the upper surfaces of the cover lock receiving parts 26, whereby the cover 60 is maintained in the state in which it is restrained from being detached from the housing 20 in the lower direction (direction intersecting the fitting direction).

Next, as illustrated in FIG. 1, the housing 20 is set to face the counterpart housing 90, and in this state, the fitting of the housings 20, 90 is started. The housing 20 is caused to progress toward the fitting position with the counterpart housing 90, while during this period, there is substantially no interfering object facing the housing 20 in the fitting direction, including the solenoid 80. Due to this, the housing 20 can reach the fitting position with the counterpart housing 90 without any difficulty. Moreover, in the course of reaching the fitting position with the counterpart housing 90, the cover arc surface 66 of the cover 60 is caused to be along the outer peripheral surface of the solenoid 80, so that the housing 20 is smoothly guided to the fitting position with the counterpart housing 90.

When the housings 20, 90 are fitted, the housing 20 is inserted in the hood part 91, and the terminal metals 50 are conductively connected to counterpart terminal metals. In this state, the back-plate part 62 of the cover 60 makes contact with the eaves part 22 from below, and the base part 61 makes contact with the partition parts 28 and the arm parts 29 from below, so that the cover 60 is restrained from being displaced upward relative to the housing 20. Further, the engagement protrusions 64 of the cover locking parts 63 makes contact with the cover lock receiving parts 26 from above, whereby the cover 60 is restrained from being displaced downward relative to the housing 20.

Furthermore, the cover arc surface 66 of the base part 61 face the outer peripheral surface of the solenoid 80 so that the cover 60 is arranged to face the solenoid 80 in proximity thereto in a direction where the cover 60 is detached from the housing 20 (downward). In short, the cover 60, in the state of being attached to the housing 20, is arranged so as to be interposed between the eaves part 22 of the housing 20 and the solenoid 80 in the up and down direction. Due to this, even when a strong external force directed downward that causes the cover 60 to be detached from the housing 20 acts thereon, and the engagement of the cover locking parts 63 and the cover lock receiving parts 26 is exposed to the risk of being detached, the cover 60 can be prevented from being completely detached from the housing 20 due to the solenoid 80 being located in a direction along which the external force acts (lower side).

As described above, according to the embodiment, since the cover 60 faces the solenoid 80 in the direction separating from the housing 20 so that the cover 60 is interposed between the solenoid 80 and the housing 20, the retained state of the cover 60 relative to the housing 20 is maintained stably.

Further, since the housing 20 is prevented from interfering with the solenoid 80 in the fitting direction when the housing 20 attached with the cover 60 starts to fit to the counterpart housing 90, the fitting work of the housings 20, 90 can be performed smoothly.

Further, since the cover arc surface 66 of the cover 60 has the form substantially along the outer peripheral surface of the solenoid 80, the cover 60 and the housing 20 are prevented from interfering with the solenoid 80 when the solenoid 80 is angularly displaced about the axis parallel to the fitting direction.

Further, in a case where the cover locking parts 63 are in a state of being half-engaged to their corresponding cover lock receiving parts 26 at the start of fitting the housings 20, 90, for example, if one of the cover locking parts 63 is detached from its cover lock receiving part 26 and comes to be in a half-hooked state, and the cover 60 is in a state of protruding downward from the housing 20 than the normal attachment, the base part 61 of the cover 60 interferes with an end surface of the solenoid 80, and the fitting operation of the housings 20, 90 can thereby be stopped. Due to this, the half-engaged state of the cover 60 can be detected.

Hereinbelow, other embodiments of the present invention will briefly be described.

The housing or the cover may be configured to make contact with the outer peripheral surface of the solenoid.

The peripheral member is not limited to the solenoid, and for example, it may be an automobile part other than the solenoid that is arranged in proximity to the connector. The peripheral member is preferably a part that is directly or indirectly fixed to a vehicle body.

The peripheral member may be arranged to face the rear side of the cover so that the peripheral member is configured to restrain the cover from being detached rearward separating away from the rear surface of the housing (electric wire outdrawing surface).

REFERENCE SIGNS LIST

10: Connector
20: Housing
22: Eaves part
25: Through Part
26: Cover Lock Receiving Part
60: Cover
61: Base Part
63: Cover Locking Part
66: Cover Arc Surface
80: Solenoid (Peripheral Member)
90: Counterpart Housing
100: Electric Wire

The invention claimed is:

1. A fitting structure for a connector comprising:

a housing configured to be fit to a counterpart housing, the counterpart housing being provided to be fixed to a peripheral member and the housing being arranged in proximity to or in contact with the peripheral member when fitting the housing to the counterpart housing, the housing including a locking part capable of engaging with and retaining the counterpart housing in a fitted state; and a cover that is independent from the housing and attached to the housing so as to cover an electric wire drawn out from an electric wire outdrawing surface of the housing, the cover having an outlet opening that guides out the electric wire, wherein when the housing fits to the counterpart housing, the cover is faced by the peripheral member in a separating direction of the cover from the housing so that the cover is arranged to be interposed between the housing and the peripheral member.

2. The fitting structure according to claim 1, wherein the separating direction of the cover from the housing is set to be a direction intersecting a fitting direction to the counterpart housing, and the peripheral member is arranged at a position where the peripheral member can avoid an interference with the housing that has progressed along the fitting direction when the housing fits to the counterpart housing.

3. The fitting structure according to claim 2, wherein, in the cover, a surface on an opposite side from a surface facing the electric wire has an arc shape that is extending substantially along an outer peripheral surface of the peripheral member about an axis parallel to the fitting direction to the counterpart housing.

4. The fitting structure according to claim 3, wherein the peripheral member is a cylindrical solenoid having its axis center directed in the fitting direction.

5. The fitting structure according to claim 1, wherein the counterpart housing is set on the peripheral member.

6. The fitting structure according to claim 1, wherein the housing includes a housing main body configured to house a terminal metal connected to the electric wire and an eaves part that integrally protrudes out from the housing main body in the fitting direction of the counterpart housing, the cover includes a base part, and a cover locking part that protrudes out from the base part in a direction intersecting the fitting direction, when assembling the cover to the housing, the cover is restrained from being detached in a direction intersecting the fitting direction by the cover locking part being engaged with a cover lock receiving part of the housing, a through part for passing the electric wire is formed to be sectioned between the base part and the eaves part, and a surface of the base part on an opposite side from a surface facing the electric wire is arranged to face the peripheral member.

7. The fitting structure according to claim 1, wherein, in the cover, a surface on an opposite side from a surface facing the electric wire has an arc shape that extends substantially along an outer peripheral surface of the peripheral member about an axis parallel to the fitting direction to the counterpart housing.

8. The fitting structure according to claim 1, wherein the outlet opening of the cover is configured to guide out the electric wire in a direction transverse to the fitting direction of the housing to the counterpart housing.

9. The fitting structure according to claim 8, wherein the outlet opening of the cover is configured to guide out the electric wire in a direction transverse to the separating direction of the cover from the housing.

* * * * *